US008464910B2

(12) United States Patent
Larson et al.

(10) Patent No.: US 8,464,910 B2
(45) Date of Patent: Jun. 18, 2013

(54) MULTI-CHAMBER CONTAINER SYSTEM FOR STORING AND MIXING FLUIDS

(75) Inventors: Brian G. Larson, Alpine, UT (US); Daryl J. Tichy, Orem, UT (US)

(73) Assignee: Solutions Biomed, LLC, Orem, UT (US)

( * ) Notice: Subject to any disclaimer, the term of this patent is extended or adjusted under 35 U.S.C. 154(b) by 624 days.

(21) Appl. No.: 12/403,642

(22) Filed: Mar. 13, 2009

(65) Prior Publication Data

US 2009/0277929 A1 Nov. 12, 2009

Related U.S. Application Data

(60) Provisional application No. 61/069,438, filed on Mar. 14, 2008.

(51) Int. Cl.
*B67D 5/56* (2006.01)

(52) U.S. Cl.
USPC ..... 222/129; 222/1; 222/145.1; 220/502

(58) Field of Classification Search
USPC ..... 222/1, 23, 145.5, 129, 394, 401, 222/145.1; 220/502; 206/219–222
See application file for complete search history.

(56) References Cited

U.S. PATENT DOCUMENTS

| | | | | |
|---|---|---|---|---|
| 716,077 | A | | 12/1902 | Morrin |
| 734,467 | A | | 7/1903 | Martien |
| 2,103,999 | A | | 12/1937 | Muller et al. |
| 2,304,104 | A | | 12/1938 | Klabunde et al. |
| 3,156,369 | A | * | 11/1964 | Bowes et al. ..... 206/222 |
| 3,172,568 | A | | 3/1965 | Modderno |
| 3,255,924 | A | | 6/1966 | Modderno |
| 3,608,782 | A | | 9/1971 | Sathicq |
| 4,021,338 | A | | 5/1977 | Harkin |
| 4,130,198 | A | | 12/1978 | Aho |
| 4,264,007 | A | * | 4/1981 | Hunt ..... 206/219 |
| 4,297,298 | A | | 10/1981 | Crommelynch et al. |
| 4,311,598 | A | | 1/1982 | Verachtert |
| 4,315,570 | A | | 2/1982 | Silver et al. |

(Continued)

FOREIGN PATENT DOCUMENTS

| | | |
|---|---|---|
| GB | 2189394 | 10/1987 |
| WO | WO 03/080231 | 10/2003 |

(Continued)

OTHER PUBLICATIONS

Schuster et al; Persistent Silver Disinfectant for the Environment: Myth and Reality; Am. J. Infect. Control; Jun. 2003; pp. 309-311; vol. 32.

(Continued)

*Primary Examiner* — Kevin P Shaver
*Assistant Examiner* — Donnell Long
(74) *Attorney, Agent, or Firm* — Thorpe North & Western LLP

(57) ABSTRACT

The present disclosure is drawn to a multi-component container system and related methods for storing and mixing fluids and associated methods of use. The system provides individual component packaging which increases the shelf-life and usefulness of the multi-component system while reducing or eliminating hazards associated with increased component concentration. Specifically, the system can provide a multi-chamber container system for storing and mixing fluids in which at least one chamber is substantially encapsulated within another chamber.

32 Claims, 4 Drawing Sheets

U.S. PATENT DOCUMENTS 4,321,255 A 3/1982 Boden
4,371,094 A 2/1983 Hutter, III
4,414,127 A 11/1983 Fu
4,509,641 A 4/1985 Scieri et al.
4,618,444 A 10/1986 Hudson et al.
4,651,899 A * 3/1987 Pauls et al. ..... 222/130
4,655,975 A 4/1987 Snoble
4,750,615 A 6/1988 Kaufeler
4,779,763 A 10/1988 Klawitter
4,808,006 A 2/1989 Kaufeler
4,826,658 A 5/1989 Kay
4,832,968 A 5/1989 Forage et al.
4,915,955 A 4/1990 Gormori
5,152,965 A 10/1992 Fisk et al.
5,186,323 A * 2/1993 Pfleger ..... 206/221
5,291,991 A 3/1994 Meyer
5,349,083 A 9/1994 Grougham et al.
5,357,636 A 10/1994 Dresdner et al.
5,368,867 A 11/1994 Da Silva et al.
5,405,051 A 4/1995 Miskell
5,409,141 A 4/1995 Kikuchi et al.
5,419,445 A * 5/1995 Kaesemeyer ..... 215/11.1
5,419,908 A 5/1995 Richter et al.
5,437,858 A 8/1995 Hungerbach et al.
5,494,644 A 2/1996 Thomas et al.
5,508,046 A 4/1996 Cosentino et al.
5,563,132 A 10/1996 Bodaness
5,638,992 A 6/1997 Lim et al.
5,709,870 A 1/1998 Yoshimura et al.
5,730,326 A 3/1998 Kaeser
5,772,017 A * 6/1998 Kang ..... 206/222
5,813,557 A 9/1998 Oratz
5,824,267 A 10/1998 Kawasumi et al.
5,875,889 A 3/1999 Albisetti
5,945,032 A 8/1999 Breitenbach et al.
5,951,993 A 9/1999 Scholz et al.
5,977,403 A 11/1999 Byers
5,997,585 A 12/1999 Scialla et al.
6,021,892 A 2/2000 Baudin
6,027,469 A 2/2000 Johnson
6,073,803 A 6/2000 Sturm et al.
6,085,945 A 7/2000 Fransen
6,114,298 A 9/2000 Petri et al.
6,152,296 A * 11/2000 Shih ..... 206/222
6,189,735 B1 * 2/2001 Plasmati-Luchinger ..... 222/1
6,197,814 B1 3/2001 Arata
6,200,946 B1 3/2001 Blume et al.
6,218,351 B1 4/2001 Busch et al.
6,231,848 B1 5/2001 Breitenbach et al.
6,242,009 B1 6/2001 Batarseh et al.
6,257,253 B1 7/2001 Lentsch et al.
6,277,414 B1 8/2001 Elhaik et al.
6,293,433 B1 9/2001 Joulia
6,302,968 B1 10/2001 Baum et al.
6,368,611 B1 4/2002 Whitbourne et al.
6,379,712 B1 4/2002 Yan et al.
6,401,975 B2 * 6/2002 Diaz et al. ..... 222/1
6,436,342 B1 8/2002 Petri et al.
6,524,624 B1 2/2003 Morelli et al.
6,540,791 B1 4/2003 Dias
6,543,612 B2 * 4/2003 Lee et al. ..... 206/222
6,569,353 B1 5/2003 Giletto et al.
6,583,176 B2 6/2003 Arata et al.
6,630,172 B2 10/2003 Batarseh
6,660,289 B1 12/2003 Wilmotte et al.
6,743,348 B2 6/2004 Hollady et al.
6,797,302 B1 9/2004 Ben Yehuda et al.
6,827,766 B2 12/2004 Carnes et al.
6,851,580 B2 * 2/2005 Stank et al. ..... 222/129
6,866,145 B2 3/2005 Richards et al.
6,936,566 B2 8/2005 Mees et al.
6,939,564 B2 9/2005 Ranger et al.
6,959,807 B2 11/2005 Sharon et al.
6,962,714 B2 11/2005 Hei et al.
7,033,511 B2 4/2006 Zawada et al.
7,083,043 B2 8/2006 Sharon
7,124,788 B2 10/2006 Pericard
7,131,784 B2 11/2006 Lee et al.
7,287,670 B2 * 10/2007 Yoshida et al. ..... 222/1
7,351,684 B2 4/2008 Tichy et al.
7,377,383 B2 * 5/2008 Henry ..... 222/129
7,462,590 B2 12/2008 Tichy et al.
7,473,675 B2 1/2009 Tichy et al.
7,504,369 B2 3/2009 Tichy et al.
7,507,701 B2 3/2009 Tichy et al.
7,511,007 B2 3/2009 Tichy et al.
7,534,756 B2 5/2009 Tichy et al.
7,553,805 B2 6/2009 Tichy et al.
2002/0108968 A1 8/2002 Dumont
2002/0137648 A1 9/2002 Sharma et al.
2003/0008797 A1 1/2003 Hage et al.
2003/0099717 A1 5/2003 Cabrera
2003/0235623 A1 12/2003 Van Oosterom
2004/0089372 A1 * 5/2004 Higgins et al. ..... 141/103
2004/0170742 A1 9/2004 Ben Yehuda et al.
2004/0234569 A1 11/2004 Nakada et al.
2005/0013836 A1 1/2005 Raad
2005/0194357 A1 9/2005 Liu et al.
2005/0256017 A1 11/2005 Dykstra
2005/0256200 A1 11/2005 Burkhart et al.
2006/0006434 A1 1/2006 Maeda et al.
2006/0035808 A1 2/2006 Ahmed et al.
2006/0122082 A1 6/2006 Paul
2006/0182813 A1 8/2006 Holladay
2006/0198798 A1 9/2006 Tichy et al.
2006/0240381 A1 10/2006 Rizolu et al.
2006/0289316 A1 12/2006 Henry
2007/0003603 A1 1/2007 Karandikar et al.
2007/0048175 A1 3/2007 Tichy et al.
2007/0073081 A1 3/2007 Fisher
2007/0167340 A1 7/2007 Barthel et al.
2007/0215496 A1 9/2007 Scarborough
2007/0254044 A1 11/2007 Karandikar et al.
2008/0000931 A1 1/2008 Tichy et al.
2008/0083779 A1 * 4/2008 Saravanane et al. ..... 222/129
2009/0004289 A1 1/2009 Tichy
2009/0053323 A1 2/2009 Tichy
2009/0232860 A1 9/2009 Larson
2010/0074967 A1 3/2010 Tichy
2010/0116346 A1 5/2010 Larson
2010/0120913 A1 5/2010 Larson
2010/0143496 A1 6/2010 Larson

FOREIGN PATENT DOCUMENTS

WO WO2004/067159 4/2004
WO WO 2005/000324 1/2005
WO WO2006/079109 7/2006

OTHER PUBLICATIONS

Brady et al; Persistent Silver Disinfectant for the Environment Control of Pathogenic Bacteria; Am. J. Infect. Control; Aug. 2004; pp. 208-214; vol. 31, No. 4.

Brentano et al; Antibacterial Efficacy of a Colloidal Silver Complex; Surg. Forum; 1966; pp. 76-78; vol. 17.

Phillips et al.; Chemical Disinfectant; Annual Review of Microbiology; Oct. 1958; pp. 525-550; vol. 12.

Monarca et al.; Decontamination of Dental Unit Waterlines Using Disinfectats and Filers; Abstract Only; Minerva Stomatol.; Oct. 2002; vol. 10.

Yin; Analysis of Diacyl Peroxides by Ag Coordination Ionspray Tandem Mass Spectrometry: Free Radical Pathways of Complex Decomposition; J. Am. Soc. Mass Spectrum; Apr. 2001; pp. 449-455; vol. 12, No. 4.

http://web.archive.org/web/20060217191603/http://sanosilbiotech.com/start_food.html, Virosil F&B Swift Veridical with Swiss Precision; Feb. 17, 2006; 5 pages.

Surdeau et al; Sensitivity of Bacterial Biofilms and Planktonic Cells to a New Antimicrobial Agent, Oxsil 320N; Journal of Hospital Infection; 2006; pp. 487-493; vol. 62; www.sciencedirect.co.

Pedahzur et al; The Interaction of Silver Ions and Hydrogen Peroxide in the Inactivation of *E Coli*; A Preliminary Evaluation of a New Long Lasting Residual Drinking Water Disinfectant; Water Science and Technology; 1995; pp. 123-129; vol. 31, No. 5-6.

Psi; Venting Products; Circumvent and AirFoil; 4 pages.

Psi; Container Venting; Linerless Application; http://www.psix.com/cv_products_linerless.htm; as accessed on Nov. 12, 2008; 1 page.
Psi; Container Venting; Circumvent and AirFoil; http://www.psix.com/CV_products_circumvent.htm; as accessed on Nov. 12, 2008; 1 page.
Psi; Container Venting; http://www.psix.com/containerventing.htm; as accessed on Nov. 12, 2008; 1 page.
Psi; Problems We Solve; http://psix.com/cv_problems.htm; as accessed on Nov. 12, 2008; 2 pages.
U.S. Appl. No. 12/617,557, filed Nov. 12, 2009; Brian G. Larson; office action issued Dec. 23, 2011.
Klenk et al; Peroxy Compounds, Organic; Ullmann's Encyclopedia of Industrial Chemistry; published online Jun. 15, 2000.
SeaquistPerfect Dispensing Bag on Valve. http://www.seaquistperfect.com/PAGES/EP/BOV.html. As accessed on Mar. 3, 2008. 2 pages.
SeaquistPerfect Dispensing, Fusion. http.www.seaquistperfect.com/PAGES/CO_DISPENSING/fusion.html. As accessed on Mar. 3, 2008. 2 pages.

* cited by examiner

MULTI-CHAMBER CONTAINER SYSTEM FOR STORING AND MIXING FLUIDS

This application claims the benefit of U.S. Provisional Application No. 61/069,438, filed Mar. 14, 2008.

BACKGROUND

Many compositions are made of two or more components which are not mixed together until shortly before use of the compositions. For example, some disinfectant or cleaning compositions include two or more components. In many such cases, at least one of the components can have a reduced chemical stability when diluted or some other reduced shelf-life once combined into the final compositions. Therefore, it can be beneficial it can be beneficial to package some compositions as separate components in multi-component systems which can be combined shortly before use. Typically, individual components in a multi-component system are packaged at higher concentration, and then are combined in a final combined composition. Unfortunately, for some compositions, increased concentrations of certain components can render the component hazardous, thereby requiring increased costs associated with packaging, shipping, and handling of the hazardous component.

DETAILED DESCRIPTION

Figure 1:
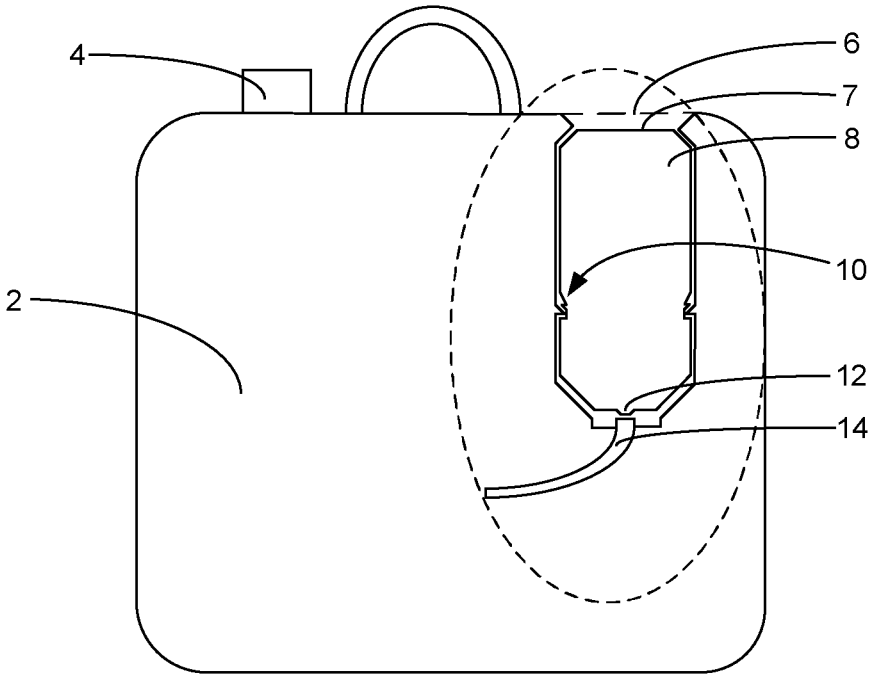
FIG. 1 is a cross-sectional schematic view of a two-chamber storage and mixing system in accordance with embodiments of the present disclosure.

Reference will now be made to the exemplary embodiments, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

It is also to be understood that the terminology used herein is used for the purpose of describing particular embodiments only. The terms are not intended to be limiting unless specified as such.

It must be noted that, as used in this specification and the appended claims, the singular forms "a," "an," and "the" include plural referents unless the content clearly dictates otherwise.

The term "multi-part" when referring to the systems of the present invention is not limited to systems having only two parts. For example, the system can have two or more fluids or liquids which are present in a single system.

The terms "encapsulated" or "substantially encapsulated" when referring to the disposition of a chamber with respect to another chamber refers to a chamber which is surrounded by a separate chamber in such a manner as to expose no more than one exterior surface of the substantially encapsulated chamber to the outside environment. Further, a substantially encapsulated chamber cannot be readily removed from its substantially encapsulated location without altering, distorting, or damaging the encapsulating chamber. In some embodiments, a second chamber is encapsulated by a first chamber, but is in actuality within a sub chamber of the first chamber. This is still considered to be a second chamber encapsulated with a first chamber.

In describing embodiments of the present invention, reference will be made to "first" or "second" chambers, compartments or liquid compositions as they relate to one another and the drawings, etc. It is noted that these are merely relative terms, and a compartment or composition described or shown as a "first" compartment or composition could just as easily be referred to a "second" compartment or composition, and such description is implicitly included herein.

Discussion of fluids or liquids herein does not require that each component be completely fluid of liquid. For example, a fluid or liquid can be a solution or even a suspension. Thus, a colloidal metal-containing fluid or liquid is considered to be a fluid or liquid as defined herein.

The term "irreversible release mechanism" can include a combination of elements that work together to allow for release of a fluid from one container into another in an irreversible manner. For example, an irreversible release mechanism, in one embodiment, can include a release element, such as nozzle, in combination with a locking mechanism, which prevents the release element from stopping its release of fluids from a chamber once it has begun. Other irreversible release mechanisms can also be used in accordance with embodiments of the present invention.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of about 1 wt % and about 20 wt %, but also to include individual weights such as 2 wt %, 11 wt %, 14 wt %, and sub-ranges such as 10 wt % to 20 wt %, 5 wt % to 15 wt %, etc.

In accordance with these definitions and embodiments of the present invention, a discussion of the various systems and methods is provided including details associated therewith. This being said, it should be noted that various embodiments will be discussed as they relate to the systems and methods.

Regardless of the context of the specific details as they are discussed for any one of these embodiments, it is understood that such discussion relates to other all other embodiments as well.

Accordingly, the present disclosure is drawn to a multi-component container system for storing and mixing fluids and associated methods of use. The system provides individual component packaging which increases the shelf-life and usefulness of the multi-component system while reducing or eliminating hazards associated with increased component concentrations. Specifically, the present disclosure provides for a multi-chamber container system for storing and mixing fluids. The system includes a first chamber configured to contain a fluid and a second chamber configured to retain a pressurized fluid. The first chamber can include a sealable opening from which to dispense the fluid. The second chamber can be substantially encapsulated in the first chamber and can have an irreversible release mechanism which is capable of facilitating the complete expulsion of the pressurized fluid from the second chamber into the first chamber. The system is configured such that the pressurized fluid in the second chamber is inaccessible under normal usage except through expulsion into the first chamber.

In another embodiment, the disclosure provides a method of storing and mixing multiple fluids to form a mixed fluid composition. The method includes the steps of providing a system having a first chamber and a second chamber, disposing a first fluid in the first chamber and a pressurized fluid in the second chamber, expelling the pressurized fluid from the second chamber into the first chamber by activating the irreversible release mechanism, allowing the first fluid and the pressurized fluid to mix in the first chamber to form a mixed fluid, and dispensing the mixed fluid from the first chamber. The system's first chamber can be configured to contain a fluid and can have a sealable opening from which to dispense the fluid once mixed with the contents of the second container. The system's second chamber can be substantially encapsulated in the first chamber and can have an irreversible release mechanism capable of facilitating the complete expulsion of the pressurized fluid from the second chamber into the first chamber. Further, the system can be configured such that the pressurized fluid in the second chamber is inaccessible under normal usage except through expulsion into the first chamber.

FIG. 1 shows a cross-sectional schematic view of one embodiment of a two-chamber system of the present disclosure. The two-chamber system includes a first chamber 2 and a second chamber 8 which is substantially encapsulated within the first chamber. The first chamber includes a sealable opening 4 which can be sealed by any means known in the art, including, but not limited to, screwed or clamped on caps and lids, corks, stoppers, ruptureable seals or membranes, or the like. The second chamber is a smaller chamber than the first chamber and is at least partially encapsulated by the first chamber. In one embodiment, the second chamber is substantially to completely encapsulated by the first chamber.

In the embodiment shown in FIG. 1, the second chamber 8 has an upper surface 7 which has minimal exposure to the outside environment when opening 6 has no cover. In some embodiments, the opening 6 can be covered by a thin film or membrane which can be ruptured or otherwise removed in order to access and subsequently activate an irreversible release of the fluid contained in the second chamber. In FIG. 1 the irreversible release of the fluid from the second chamber to the first chamber is facilitated by a locking system 10, which is shown in a first, or unlocked, position. The systems of the present invention can be stored with the second chamber in the unlocked or first position with respect to the first chamber for extended periods of time without allowing interaction or mixing between the pressurized fluid of the second chamber and the fluid of the first chamber. In the embodiment shown in FIG. 1, the second chamber can include a dispensing element 12 which, when depressed against a release conduit 14, the fluid of the second chamber is released into the first chamber. In other words, by pressing the second chamber downwardly through opening 6, the locking mechanism is irreversibly engaged, thereby causing the irreversible release of the fluid from the second container into the first chamber.

Figure 2A:
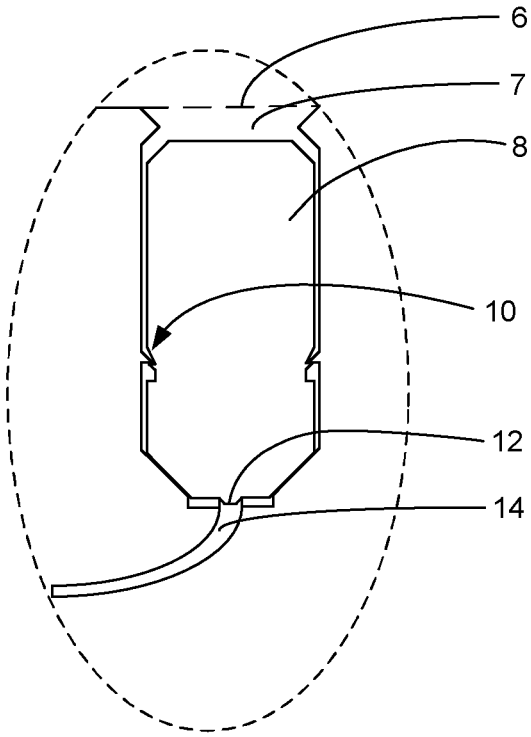
FIG. 2A is an enlarged view of portion of FIG. 1 in which the second chamber is shown in the locked or second position.

FIG. 2A shows a slightly enlarged portion of FIG. 1, except that the second chamber is shown in an activated, locked, or second position with respect to the first chamber. As discussed above, the systems of the present invention can include a second chamber 8 which can be present in either a first or second position with respect to the first chamber 2. The first chamber can include sealable opening 4, as described previously. In FIG. 2A the irreversible locking mechanism 10 shown in FIG. 2A has been triggered or locked through the application of pressure to the upper surface 7 of the second chamber, which in turn causes the complete or substantially complete expulsion of the pressurized fluid present in the second chamber into the first chamber. In embodiments where the opening 6 is covered by a membrane, film, or other covering, the covering can be ruptured or removed in order to move the second chamber to the second position. The covering of the opening can also be a stretchable or flexible covering which would allow pressure to be transferred through the cover to the upper surface of the second chamber in order to move the second chamber into the second position with respect to the first chamber. The activation or movement of the second chamber into the second position causes the dispensing element 12 to become depressed and engaged with the release conduit 14, thereby allowing the expulsion or release of the pressurized contents in the second chamber into the first chamber.

Figure 2B:
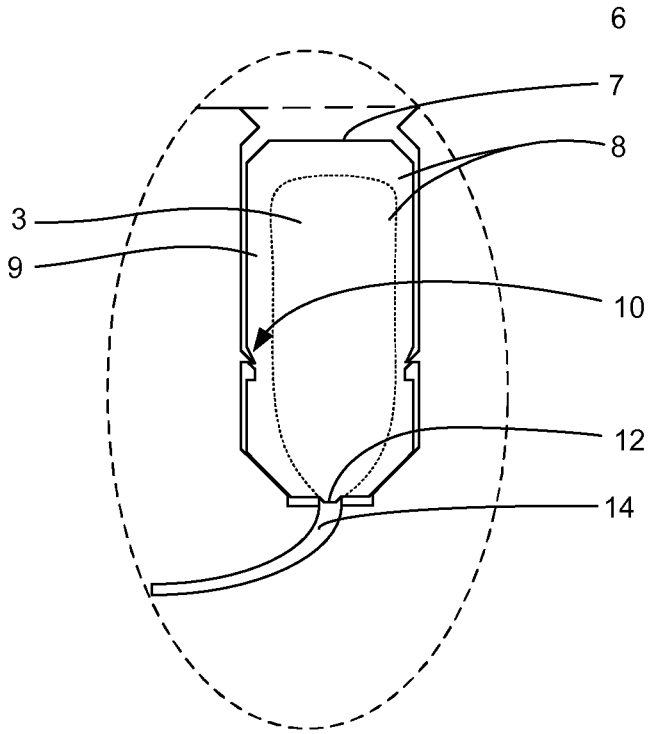
FIG. 2B is similar to FIG. 2A except that it shows a two compartment version of the second chamber.

FIG. 2B also shows a slightly enlarged portion of FIG. 1 again, except that the second chamber 8 is shown in the second, locked position, and further, includes an embodiment in which the second chamber is divided into two compartments: an inner compartment 3 and an outer compartment 9. All of the other elements are shown and numbered similarly as described above with respect to FIGS. 1 and 2A, and are not re-described here. The two compartment second chamber can be used to increase the number of fluids held in the second chamber and/or to increase the efficiency of expulsion of the pressurized fluid from the second chamber. In one aspect, the pressurized fluid can be contained within the inner compartment of the second chamber. The fluid can be pressurized by the outer compartment. This configuration can allow for a pressurized release of the fluid present in the inner compartment without release of the pressurizing gas or fluid present in the outer compartment. The configuration further provides for near complete expulsion of the fluid in the interior compartment regardless of orientation of the second compartment with respect to the first compartment. Another advantage of the embodiment shown in FIG. 2B arises when the pressurized fluid is corrosive. The corrosive fluid can be isolated within the inner compartment of the second chamber, thereby protecting the exterior chamber walls of the chamber from being corroded. The embodiment shown in FIG. 2B can also provide a benefit with respect to the stability and degradation of the pressurized fluid. Some active agent components in the pressurized fluid may be susceptible to degradation, e.g. oxidative degradation, when they are placed in contact with a pressurized gas propellant. By isolating the pressurized fluid in the inner compartment of the second chamber, with the propellant gas in the outer compartment, degradation rates of the pressurized fluid, or components of the pressurized fluid, can be reduced. As such, this configuration of the second compartment can be used in any embodiment of the systems of the present invention including those shown in FIGS. 3A, 3B, 4, 5A and 5B, as well as other similar embodiments.

In another aspect of the embodiment shown in FIG. 2B, the inner compartment 3 can be filled with a first pressurized fluid and the outer compartment 9 can be filled with a second pressurized fluid. When both the outer and inner compartments of the second chamber contain pressurized liquids, for example, the fluids can be simultaneously mixed and expelled through the same release element 12. In such configurations, the pressurization of the fluids can be accomplished by pressurizing one or both compartments of the second chamber. Non-limiting examples and mechanisms which can be used with any of the above described two compartment embodiments can be found in U.S. Pat. Nos. 5,730,326; 6,085,945; and 7,124,788; the entirety of each is incorporated herein by reference.

Figure 2C:
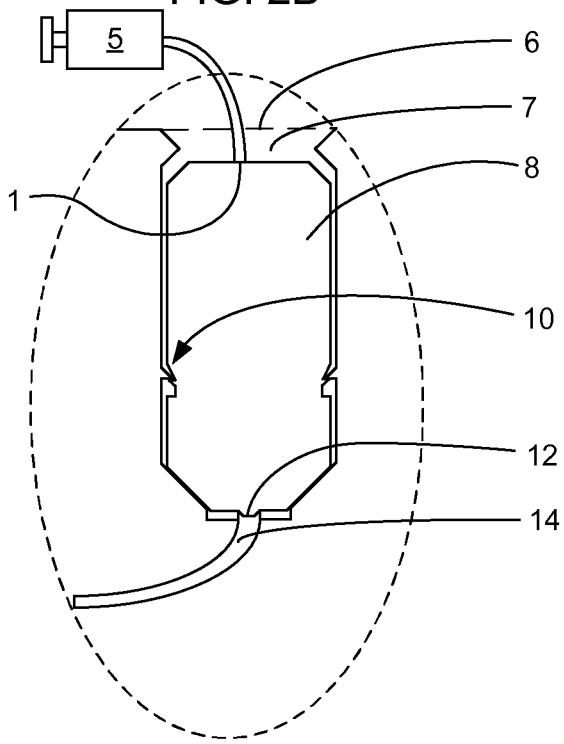
FIG. 2C is similar to FIG. 2A except it includes an exterior pump or pressurization system which is used to pressurize the fluid within the second chamber.

FIG. 2C shows a slightly enlarged portion of FIG. 1 except that it includes an external pump 3 which is connected to the second chamber 8 in order to pressurize the contents of the chamber after placement of the second chamber in the first chamber. Again, all of the other elements are shown and numbered similarly as described above with respect to FIGS. 1 and 2A, and are not re-described here. As discussed herein, the second chamber of the system of the present invention is configured to contain a pressurized fluid. The pressurization can be carried out at any point during the manufacturing process of the system, including prior to placement of the second chamber within the first chamber. The pressurization of the fluid present in the second chamber can also be carried out using a pump or pressurization system, manual or automatic, after the second chamber is substantially encapsulated within the first chamber. When pressurization is carried out after the second chamber is substantially encapsulated in the first chamber, it can be carried out at any time prior to activation or locking of the second chamber into its expelling position, e.g. prior to shipping, after shipping, by the user just prior to use, etc. When, as in FIG. 2C, a pump is used to pressurize the contents of the second chamber, the pump can be connected to the second chamber through a one-way valve or connector 1 located on an exposed or accessible surface of the second chamber.

In one embodiment of the present disclosure, the system may include an indicator (not shown) which can indicate the pressure level of the second chamber. Such an indicator can be advantageous when the pressurization is done by an end-user after the second chamber is encapsulated within the first chamber. The indicator would also be beneficial in indicating when the pressurized fluid has been expelled from the second chamber 8 in order to guide a user with respect to the completion of the expulsion of the pressurized fluid from the second chamber into the first chamber 2.

Figure 3A:
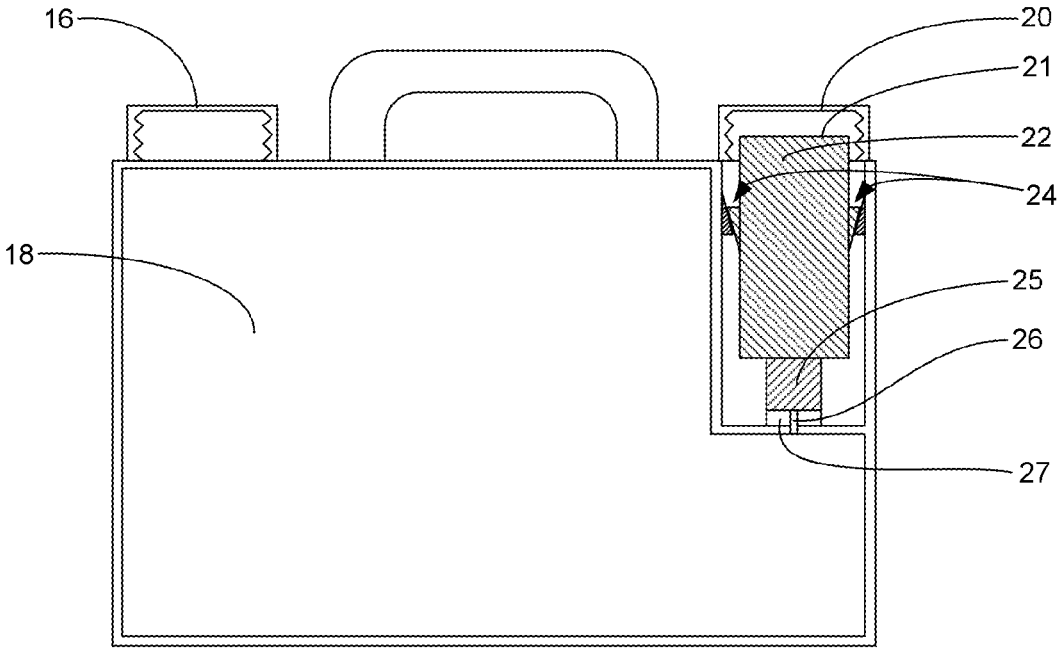
FIG. 3A is a cross-sectional schematic view of a second embodiment of a two-chamber storage and mixing system in accordance with embodiments of the present disclosure.
Figure 3B:
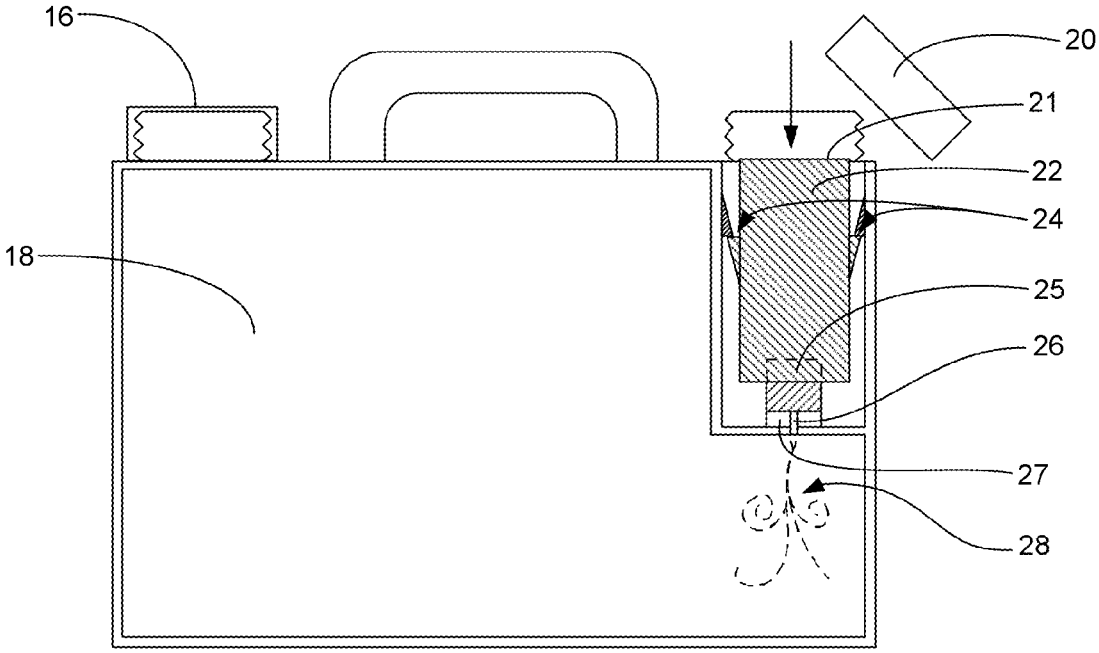
FIG. 3B is similar to FIG. 3A except that it shows the second chamber in a locked, or second position used to expel the contents of the second chamber.

FIGS. 3A and 3B show a cross-sectional schematic view of another two-chamber system embodiment. The first chamber 18 is similar to that shown in FIG. 1, except that the sealable opening (of the first chamber) is sealed by a threaded cap 16. The second chamber 22 is substantially encapsulated within the first chamber, i.e. a sub-compartment of the first chamber, and has an upper surface 21 which is accessible by removing a cap or access cover 20. When the access cover is removed, mechanical pressure of some type, e.g., pressing with a finger or instrument, can be applied to the upper surface of the second chamber, which causes the second chamber to move from a first unlocked position shown in FIG. 3A, to a second locked position, shown in FIG. 3B (see irreversible locking mechanism 24). The application of downward pressure to the upper surface of the second chamber causes the release element 25 of the second chamber to be depressed, thereby allowing the pressurized fluid in the second chamber to be expelled through a release conduit 26 into the first chamber 18. In actuality, in this embodiment, the release mechanism remains stationary as the second chamber is moved vertically downward, thereby engaging the release mechanisms with respect to the second chamber so as to cause fluid expulsion from the second chamber into the first chamber. The release mechanism in this embodiment is held stationary to downward pressure by a protrusion 27, which in this case, has a channel therethrough for holding the release conduit 28 in position. FIG. 3B depicts fluid mixing 28 as fluid is expelled in a turbulent manner from the second chamber into the first chamber. When the pressurized fluid of the second chamber is released into fluid present in the first chamber, the pressure change and fluid dynamics can cause turbulence in the fluids such that they rapidly mix to form a somewhat homogenously mixed fluid. In some cases it can be desirable to provide additional mixing of the fluids any means known in the art such as shaking or other mechanical means if mixing is not as complete as may be desired. In one embodiment, the expulsion of the fluid from the second chamber into the first chamber causes adequate mixing for the intended use of the mixed fluid.

Figure 4:
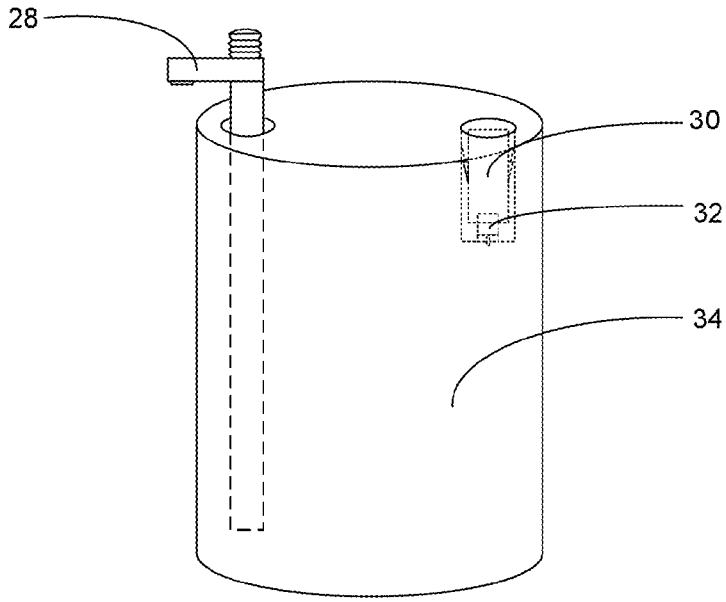
FIG. 4 shows a cross-sectional schematic view of a third system in accordance with embodiments of the present disclosure.
Figure 5A:
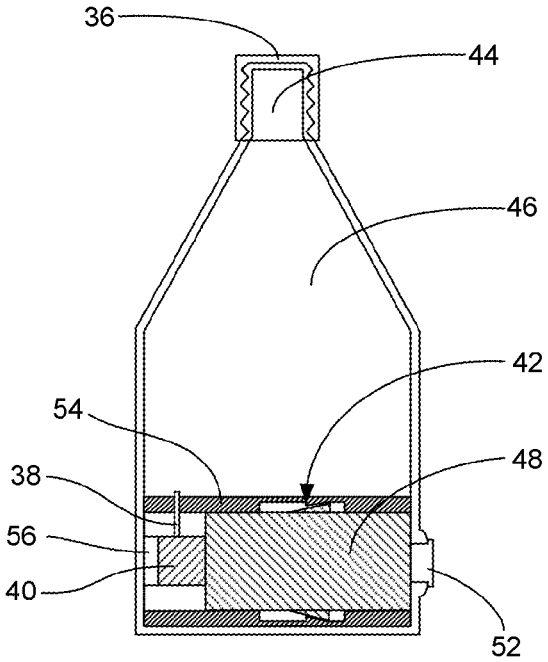
FIG. 5A is a cross-sectional schematic view of a fourth embodiment of a two-part system in accordance with embodiments of the present disclosure where the second chamber is not inverted with respect to the first chamber.
Figure 5B:
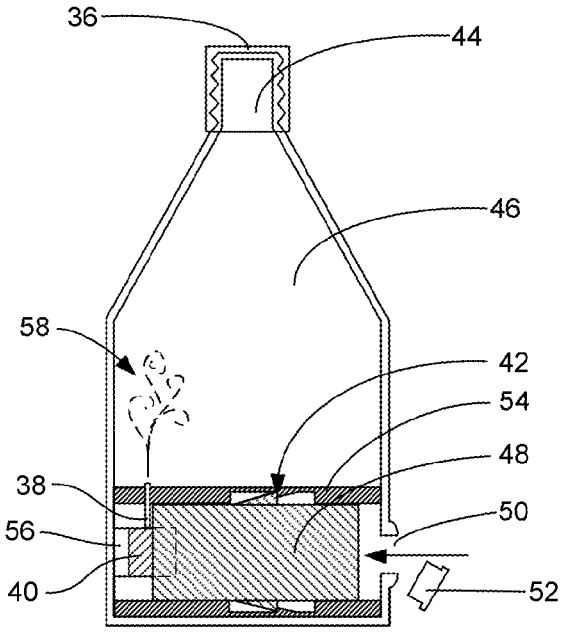
FIG. 5B is similar to FIG. 5A except that the second chamber is shown in the locked, fluid dispensing position which is used to expel the contents of the second chamber into the first chamber.

The systems and associated chambers of the present invention can be proportioned across a large size range. For example, the embodiments shown in FIGS. 1 and 3A show systems can be configured to be from less than one gallon to many gallons. Systems in these size ranges allow for relative ease is transport and use. The systems of the present invention may also be scaled up to large industrial sizes, such as a 55 gallon drums or other large containers, as shown in FIG. 4. Such scaled up systems still include a first chamber 34 and a second chamber 30 as well as a release element 32, and can generally include some or all the elements present in the smaller configurations, as described previously. Both the smaller and more industrially sized systems can include means for extracting the mixed fluid from the first chamber, such as the pump 28 shown in FIG. 4. The size ratio of the first chamber and the second chamber can be varied depending on the nature of the fluids being mixed and the desired ratios of the first fluid and the pressurized fluid. Generally, as with the previous embodiments, the ratio can be from 10,000:1 to 1:1, although these ranges are not intended to be limiting.

The second chamber of the systems of the present invention can be oriented in a variety of ways with respect to the first chamber of the system. In the embodiments shown in FIGS. 1, 2 and 3 the second chamber is inverted with respect to the first chamber, i.e. the second chamber has a release element or opening which is pointed downward or opposite the sealable opening of the first chamber. Such a configuration can be advantageous in that it can facilitate the complete or substantially complete expulsion of the pressurized fluid from the second chamber as gravity will maintain the bulk of the fluid proximate the release element.

Unlike FIGS. 1, 2A-2C, and 3A-3B, FIGS. 5A and 5B show an embodiment in which the second chamber 48 is oriented such that it is substantially perpendicular with respect to the first chamber 46. In this embodiment, the second chamber can be accessed by removing a cap or lid 52 from an access opening 50 from so that second chamber can be accessed and activated. Similar to FIGS. 3A and 3B, the activation of the second chamber can be carried out through moving the second chamber from an unlocked first position, shown in FIG. 5A, to a locked second position, shown in FIG. 5B. An irreversible locking mechanism 42 prevents the second chamber from returning to the first position once activated. As in the other embodiments, the irreversible activation of the second chamber facilitates the substantially complete expulsion of the pressurized fluid from the second chamber into the first chamber. In conjunction with the locking mechanism, this embodiment also includes a sleeve 54, which snugly fits against the second chamber to prevent unwanted movement of the second chamber other than in the direction used for activation of the system. As with other embodiments, the second chamber is encapsulated within the first chamber, albeit with its own sub-chamber. When activated the release element 40 of the second chamber is depressed (by depressing or moving the chamber against the stationary release element), which in turn causes the pressurized fluid to be released through the release conduit 38 into the first chamber 46. In this embodiment, the release element is held stationary against a protrusion 56 as the second chamber is depressed through the access opening. Although not shown in FIG. 5A or 5B, the release conduit can extend into the second chamber to a location in order to facilitate substantial complete expulsion of the pressurized fluid from the chamber. Once the pressurized fluid is expelled into the first chamber, causing fluid mixing 58, the threaded cap 36 covering the sealable opening 44 can be removed and the mixed fluid dispensed. It is noted that in some embodiments, it may be desirable to remove the cap prior to fluid mixing so as to provide a vent when it is thought that the pressure within the first chamber might increase to an undesired level.

Each of these embodiments can utilize any of a number of systems for expelling fluid from the second chamber into the first chamber. Aerosol systems, manual pumps, pressure differentials with the chamber, e.g., Bag-On-Valve™ systems (similar to those shown in FIG. 2B), etc., can be used, as long as the system is configured to generate expulsion of one fluid into another. In additional embodiments of the present invention, systems can be configured to include a third chamber and even a fourth chamber, each of which can hold additional fluids. These embodiments can be useful in order to provide increased concentrations of the end product as well as in situations in which three or more-part systems are desirable or necessary. Additionally, in one embodiment, the mixing of the first fluid with the pressurized fluid can be accomplished by the turbulence associated with the release of the pressurized fluid into the first fluid. As discussed above, this type of mixing is generally adequate to provide a homogenous mixture of the two fluids; however, when desired, additional mixing steps can be used.

The systems and methods of the present invention can be used with any multi-part fluid composition. The systems are particularly advantageous for multi-part compositions which have limited or shortened stabilities, shelf-lives or functional time periods once combined. As such, in one aspect of the present invention the step of expelling the pressurized fluid from the second chamber into the first chamber can be performed shortly before dispensing the mixed from the sealable opening of the first chamber.

The systems and methods of the present disclosure can be used with any multi-part preparations or systems. One example of a multi-part system which can be used herein is a multi-part disinfectant composition which, in its final form, can include a composition including an amount of a transition metal, e.g. a colloidal or ionic transition metal, and a peroxygen, e.g., peracids and/or peroxides. The composition could also include other ingredients such as alcohols or other organic co-solvents.

The above described disinfectant system can be effectively used to provide disinfection of a wide variety of surfaces. However, the peracid component of the composition can have a limited shelf-life, particularly at concentrations that are relatively low. As such, the system of the present invention provides an effective means for safely packaging, handling, shipping, storing, and ultimately mixing such a composition in a two-component format until shortly before use. For example, the above described disinfectant composition could be packaged into a system of the present invention such that an aqueous vehicle, including the transition metal component and/or alcohol or possibly other organic components are placed in the larger first compartment of the system, while a concentrated, and thereby more stable, peracid liquid is placed in the smaller second chamber. By maintaining a somewhat elevated concentration of peracid in the liquid of the second chamber, the peracid has an enhanced stability, and therefore a longer shelf-life. Further, the system of the present invention provides for a safe means for packaging such individually separated compositions. Typically, solutions having elevated peracid concentrations are viewed as being hazardous, and therefore, difficult to ship and sell to the public. The system of the present disclosure would allow for the peracid fluid of the system to be packaged within the second chamber, which can be non-removable from its encapsulation within the first chamber. Further, as the systems of the present invention only allow access to the fluid of the second chamber through dispensing of the fluid into the first chamber, an end user would not be exposed to the peracid until after it was diluted into the aqueous vehicle present in the first chamber.

Specific details of compositions which can be used in the systems of the present inventions are described in U.S. patent application Ser. No. 11/514,721, which is incorporated herein by reference.

What is claimed is:

1. A multi-chamber container system for storing and mixing fluids, comprising:

a first chamber containing a first fluid and having a sealable opening from which to dispense the first fluid, and a second chamber retaining a pressurized fluid, the second chamber being substantially encapsulated in the first chamber and having an irreversible release mechanism capable of facilitating the at least substantially complete expulsion of the pressurized fluid from the second chamber into the first chamber regardless of orientation of the second chamber with respect to the first chamber, the second chamber further being configured so that it is not removable from the first chamber without altering, distorting, or damaging the first chamber, and wherein the pressurized fluid in the second chamber is inaccessible except through expulsion into the first chamber.

2. A system as in claim 1, wherein the second chamber has a first position with respect to the first chamber and a second position with respect to the first chamber.

3. A system as in claim 2, wherein the irreversible release mechanism includes a locking mechanism, such that when the second chamber is moved from the first position to the second position, the second chamber becomes locked in the second position.

4. A system as in claim 3, wherein the irreversible release mechanism further includes a release element, wherein when the second chamber is locked in the second position, the release element becomes opened, causing expulsion of the pressurized fluid from the second chamber to enter the first chamber.

5. A system as in claim 1, wherein the second chamber is disposed within the first chamber such that the second chamber is substantially inverted when the first chamber is positioned upright.

6. A system as in claim 1, wherein the second chamber is disposed within the first chamber such that the second chamber is substantially perpendicular to the orientation of the first chamber when the first chamber is positioned upright.

7. A system as in claim 1, wherein when the system is configured such that when the pressurized fluid is expelled from the second chamber into the first chamber, the pressurized fluid and the first fluid present in the first chamber are mixed to form a homogenous mixture.

8. A system as in claim 7, wherein the mixing of the pressurized fluid and the first fluid present in the first chamber is a result of the pressurized expulsion of the pressurized fluid into the first chamber.

9. A system as in claim 1, wherein the pressurized fluid is pressurized within the second chamber prior to the second chamber being disposed within the first chamber.

10. A system as in claim 1, wherein the pressurized fluid is pressurized within the second chamber after to the second chamber is disposed within the first chamber.

11. A system as in claim 1, wherein the system further includes an indicator which indicates when the pressurized fluid has been expelled from the second chamber into the first chamber.

12. A system as in claim 1, wherein the system further includes a third chamber which is substantially encapsulated within either the first chamber, or both the first and second chamber.

13. A system as in claim 1, wherein the first fluid in the first chamber includes an alcohol.

14. A system as in claim 1, wherein the first fluid in the first chamber includes a transition metal.

15. A system as in claim 1, wherein the pressurized fluid includes a peracid.

16. A method of storing and mixing multiple fluids to form a mixed fluid composition for use, comprising:

providing a system having a first chamber and a second chamber, the first chamber being configured to contain a first fluid and having a sealable opening from which to dispense the first fluid and the second chamber being substantially encapsulated within the first chamber and having an irreversible release mechanism capable of facilitating the at least substantially complete expulsion of a second fluid from the second chamber into the first chamber regardless of orientation of the second chamber with respect to the first chamber, wherein the second fluid in the second chamber is inaccessible except through expulsion into the first chamber, and wherein the second chamber is configured so that it is not removable from the first chamber without altering, distorting, or damaging the first chamber;

disposing the first fluid in the first chamber;

pressurizing a second fluid in the second chamber;

expelling the second fluid from the second chamber into the first chamber by activating the irreversible release mechanism; and allowing the first fluid and the second fluid to mix in the first chamber to form a mixed fluid.

17. A method as in claim 16, wherein the mixing of the first fluid and the second fluid is accomplished by turbulence associated with the release of the second fluid into the first fluid.

18. A method as in claim 16, further comprising dispensing the mixed fluid from the sealable opening of the first chamber.

19. A method as in claim 16, wherein the step of expelling the second fluid from the second chamber into the first chamber is performed immediately prior to dispensing the mixed fluid from the sealable opening of the first chamber.

20. A method as in claim 16, wherein the step of expelling the second fluid from the second chamber into the first chamber includes moving the second chamber from a first position with respect to the first chamber to a second position.

21. A method as in claim 20, wherein the second position is a locked position.

22. A method as in claim 20, wherein the step of expelling the second fluid from the second chamber into the first chamber does not require movement of the second chamber with respect to its relative position to the first chamber.

23. A method as in claim 16, wherein the step of pressurizing the second fluid within the second chamber occurs prior to the second chamber being disposed within the first chamber.

24. A method as in claim 16, wherein the step of pressurizing the second fluid within the second chamber occurs after the second chamber is disposed within the first chamber.

25. A method as in claim 16, wherein the step of pressurizing the second fluid is by including high pressure gas in the second chamber with the second fluid.

26. A method as in claim 16, wherein the high pressure gas is manually pumped into the second chamber immediately prior to use.

27. A method as in claim 16, wherein the high pressure gas is pre-dispensed in the second chamber.

28. A method as in claim 16, wherein the system further includes an indicator which indicates when the pressurized fluid has been expelled from the second chamber into the first chamber.

29. A method as in claim 16, wherein the system further includes a third chamber which is substantially encapsulated within either the first chamber, or both the first and second chamber.

30. A method as in claim 16, wherein the first fluid includes an alcohol.

31. A method as in claim 16, wherein the first fluid includes a transition metal.

32. A method as in claim 16, wherein the second fluid includes a peracid.

* * * * *